US005660128A

United States Patent [19]

Wokeck

[11] Patent Number: 5,660,128

[45] Date of Patent: Aug. 26, 1997

[54] PULLER APPARATUS

[75] Inventor: Arthur C. Wokeck, Mauldin, S.C.

[73] Assignee: Clinton Industries, Inc., Carlstadt, N.J.

[21] Appl. No.: 549,089

[22] Filed: Oct. 27, 1995

Related U.S. Application Data

[63] Continuation-in-part of Ser. No. 234,829, Apr. 27, 1994, Pat. No. 5,509,366.

[51] Int. Cl.[6] ..... D05B 27/10

[52] U.S. Cl. ..... 112/318; 112/235; 112/319

[58] Field of Search ..... 112/318, 322, 112/320, 235, 307, 319; 226/124, 158, 159

[56] References Cited

U.S. PATENT DOCUMENTS

| | | | |
|---|---|---|---|
| 1,828,722 | 10/1931 | Sailer | 112/235 X |
| 1,852,482 | 4/1932 | Seavers et al. | 112/235 |
| 2,481,286 | 9/1949 | Bouwkamp | 112/235 |
| 2,611,333 | 9/1952 | Ritter | 112/235 |
| 2,687,704 | 8/1954 | Galkin | 112/318 |
| 5,509,366 | 4/1996 | Wokeck | 112/318 |

OTHER PUBLICATIONS

PFAFF 5642 Service Manual & List of spare parts Pfaff, D–6750 Kaiserslautern, Postfach 3020/3040.

*Primary Examiner*—Paul C. Lewis

*Attorney, Agent, or Firm*—Darby & Darby

[57] ABSTRACT

An apparatus in combination with a sewing machine having a stitch-former that utilizes thread, alternately engageable and disengageable with a garment having portions of different thickness material, and a feeder for feeding the garment through the stitch-former when the stitch-former is disengaged from the garment, comprises a puller roller, a feed rocker shaft, first and second presser feet and first and second pneumatic cylinders. The puller roller is positioned downstream of the feeder for uniformly pulling the garment when the stitch-former is disengaged from the garment. The feed rocker shaft is clampingly-attached to the feeder for driving the puller roller in synchronization with the stitch-former. The feed rocker shaft intermittently engages the puller roller when the stitch-former is disengaged from the garment and intermittently disengages the puller roller when the stitch-former is engaged with the garment. The first and second presser feet are positioned adjacent the puller roller for urging the garment against the puller roller. The first and second pneumatic cylinders are operatively connected to the first and second presser feet, respectively, for selectively and independently moving the first and second presser feet into and out of engagement with the portions of different thickness material of the garment.

31 Claims, 2 Drawing Sheets

PULLER APPARATUS

This application is a continuation-in-part of application Ser. No. 08/234,829 filed Apr. 27, 1994 now U.S. Pat. No. 5,509,366, the disclosure of which is hereby incorporated by reference.

FIELD OF THE INVENTION

This invention relates in general to a puller apparatus in combination with a sewing machine, and more particularly to a puller apparatus having multiple presser feet for engaging a variable thickness garment having adjacent portions, at least one of which has multiple layers of fabric, wherein each presser foot independently engages an adjacent portion for urging the garment against a rotating puller roller, thereby uniformly pulling the garment through the sewing machine so that excess threads may be cut from the garment.

BACKGROUND OF THE INVENTION

Sewing machine structures and garment feeding mechanisms have taken a variety of configurations over the years since their initial conception. Today, the general configuration of the sewing machine comprises a needle assembly, including a needle and presser foot, being driven by a shaft and a feed mechanism to move a garment past the needle assembly as it reciprocates. Traditionally, the feed mechanism takes the form of "feed dogs", i.e., elongated members located beneath the needle having serrated upper surfaces for engaging the garment and moving it toward the needle. The drive mechanism for the feed dogs is typically interconnected with the needle assembly drive mechanism so that the feed dogs do not push the garment while engaged with the needle.

This system, however, is unreliable when the material thickness of adjacent portions of a single garment varies greatly. This differs from a puller apparatus that can accommodate varying thicknesses of different garments but where each individual garment has only one material thickness. For example, the commercial fabrication of heavy jean slacks requires a thirteen ply thickness to be sewn under one presser foot and a four ply thickness to be sewn under another presser foot, as opposed to the fabrication of a garment having a uniform thickness. Using traditional puller mechanisms, the puller rollers either slow down, stop completely or slip, causing the variable thickness garment to feed improperly.

The prior art discloses an upper and lower roller which engage a garment behind a single presser foot: U.S. Pat. No. 2,687,704, Galkin, issued Aug. 31, 1954; U.S. Pat. No. 2,706,457, Galkin, issued Apr. 19, 1995; U.S. Pat. No. 4,187,795, Norton, issued Feb. 12, 1980; U.S. Pat. No. 4,318,360, Uemura et al., issued Mar. 9, 1982. One of the rollers is driven so as to impart motion to the material, along with the feed dog, when the needle is withdrawn. The force of the presser foot on the material overcomes the driving force of the rollers during that portion of the operational cycle when the feed dog disengages the material. When the feed dog engages the material, thereby pushing it, the drive roller rotates to assist in the material feed. The prior art cannot properly accommodate a single garment having adjacent portions of variable thickness fabric since the upper and lower rollers would only engage the greatest fabric thickness while leaving the thinner fabric thickness to pass uncontrolled through the stitch-forming mechanism. None of the aforesaid patents disclose a device for uniformly feeding a single garment, wherein the material thickness of adjacent portions of the garment varies greatly.

The prior art also discloses a single roller positioned substantially below the sewing machine work surface and behind a single presser foot, U.S. Pat. No. 3,198,153, Weber, issued Aug. 3, 1965. Similarly, the prior art discloses a single roller positioned substantially above the sewing machine work surface and behind a single presser foot: U.S. Pat. No. 3,625,168, Palazzo, issued Dec. 7, 1971; U.S. Pat. No. 4,996,934, Lue, issued Mar. 5, 1991. None of these patent, however, disclose a puller apparatus that can properly accommodate a single garment having adjacent portions of variable fabric.

Another deficiency of the prior art is the inability to cut excess threads from a variable thickness fabric after being moved by a roller. For example, U.S. Pat. No. 4,461,229, Angele, issued Jul. 24, 1984, discloses a roller that operates behind a needle assembly to pull a garment in order to cut thread from the garment. However, the puller wheel is positioned such that it interferes with the thread cutting process. In addition, the puller wheel is manually engaged by a lever, which further interferes with the cutting process. A puller apparatus which allows excess threads to be cut from the garment without adjusting for the interference of the puller apparatus is not disclosed. A solution would be to provide a puller roller positioned so as not to interfere with the thread cutting process.

Another deficiency of the aforesaid prior art is that the puller apparatus is disclosed to be driven by the sewing machine motor. Therefore, any adjustment or repair of the puller apparatus requires downtime of the sewing machine in order to adjust the puller roller's speed, maintain the puller roller support bearings or repair the puller apparatus.

SUMMARY OF THE INVENTION

Accordingly, it is an object of the present invention to provide a puller apparatus for use with a sewing machine that adjusts to a variable thickness garment having adjacent portions, at least one of which has multiple layers, for uniformly pulling the garment through a stitch-forming mechanism of the sewing machine for improved stitching and for moving the garment away from the stitch-forming mechanism, whereby excess threads may be cut from the garment.

It is a further object of the invention that the puller roller of the puller apparatus be selectably movable to a position that will not interfere with the operation of the sewing machine or the thread cutting process.

It is a further object of the present invention to provide a puller apparatus which is a "clamp-on" device thus requiring no disassembly of the sewing machine or retiming of the removed parts.

It is a further object of the present invention to provide a puller apparatus which is connected to the feed rocker shaft and not the feed lifter shaft, thus providing a puller apparatus which is always in synchronization with the sewing machine without the need to synchronize the puller to the feeder.

It is a further object of the invention to provide a puller apparatus in combination with a sewing machine having a stitch-forming mechanism, alternately engageable and disengageable with a garment having portions of different thickness material, and a feeder for feeding the garment through the stitch-forming mechanism when the stitch-forming mechanism is disengaged from the garment, comprises a puller positioned downstream of the feeder for uniformly pulling the garment when the stitch-forming mechanism is disengaged from the garment, a driver for driving the puller in synchronization with the stitch-forming mechanism, the driver intermittently driving the puller for advancing the garment when the stitch-forming mechanism is disengaged from the garment, first and second engagers positioned adjacent the puller, and first and second controllers operatively connected to the first and second engagers, respectively, for selectively moving the first and second engagers into and out of engagement with the portions of different thickness material, respectively, of the garment, for urging the garment against the puller when the stitch-forming mechanism is disengaged from the garment.

DETAILED DESCRIPTION OF THE INVENTION

Figure 1:
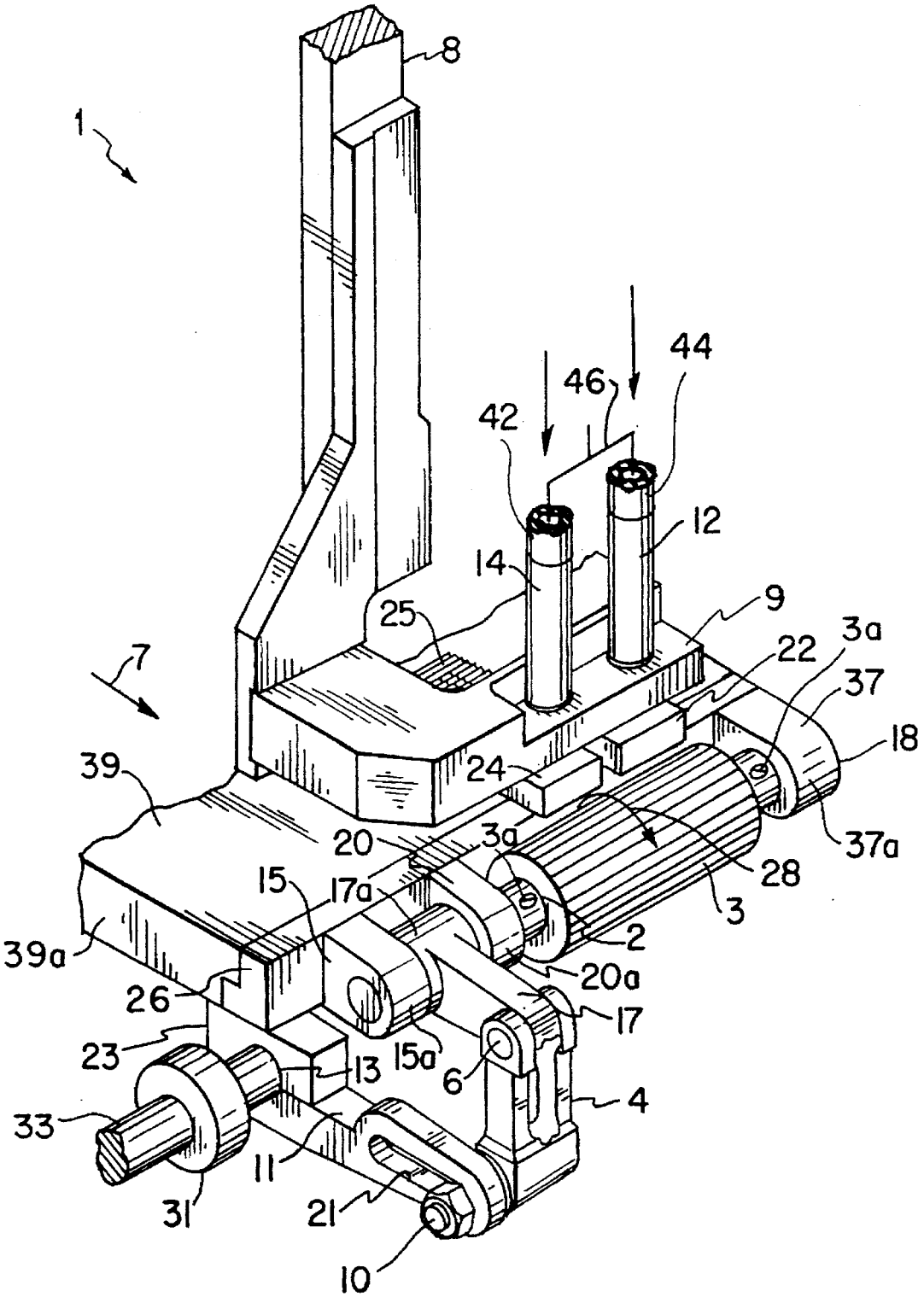
FIG. 1 is a perspective view of the preferred puller apparatus in combination with a sewing machine according to the present invention.
Figure 2:
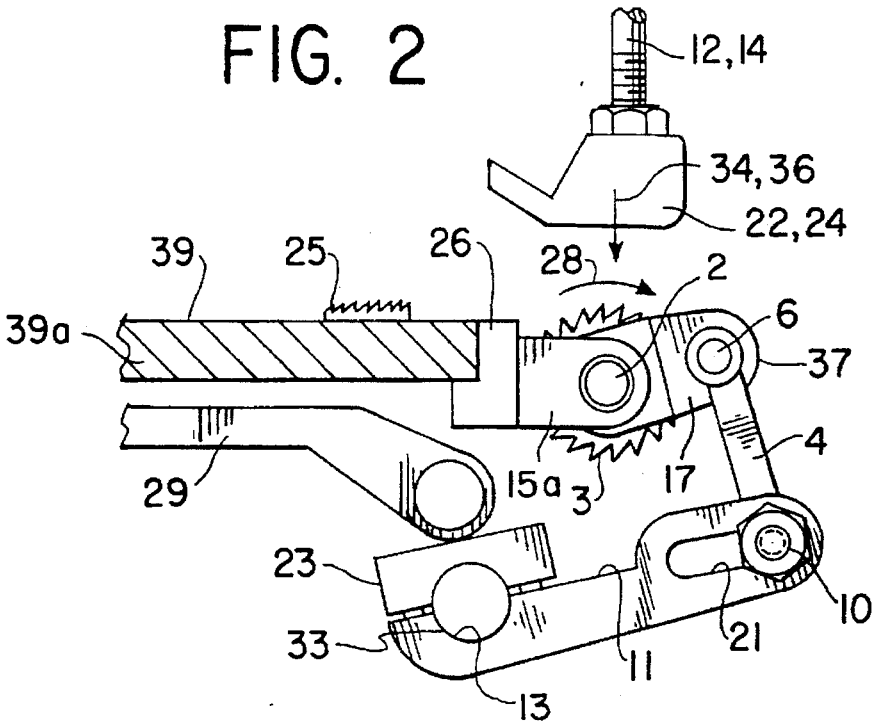
FIG. 2 is a side view of the puller roller and its drive linkage in relation to the compensating presser feet in the preferred embodiment of the present invention.

Referring to FIGS. 1 and 2, a preferred puller apparatus 1 in combination with a sewing machine having a stitch-forming needle assembly and a feeder, comprises a puller 3, a driver 33, and first and second engagers 22, 24, controlled by first and second controllers 12, 14, respectively, to accommodate a variable thickness garment 5 having top and bottom surfaces 30, 32, respectively, and first and second adjacent portions 40, 41, respectively, at least one of which has multiple layers 44 (FIG. 3) sewn on a sewing machine 8. Puller roller 3 has a serrated peripheral surface and shaft 2 is rotatably supported by spaced bearings 15, 20 and 37. In the preferred embodiment, puller apparatus 1 is attached to an industrial sewing machine 8 but may be attached to any sewing machine, conventional or industrial, without deviating from the intent of the invention.

The needle assembly and feeder of the sewing machine comprise a conventional needle (not shown), positioned above a work surface 39, and a feed dog 25, operatively attached to work surface 39, respectively, as is well known in the art. The needle assembly engages garment 5 intermittently, for stitching garment 5 with conventional thread, as garment 5 is fed across work surface 39 of plate 39*a* by feed dog 25 in downstream direction 7 toward puller roller 3. Puller roller 3 is attached to shaft 2 of mounting strip 26 by two set screws 3*a*. Mounting strip is attached to plate 39*a* and thus, puller roller 3 is positioned adjacent to feed dog 25, which advances garment 5 only when the needle assembly is disengaged from garment 5. Therefore, the needle assembly engages garment 5 when puller roller 3 is stationary and disengages garment 5 when puller roller 3 is rotating.

The preferred puller and driver of puller apparatus 1 comprise puller roller 3 and feed rocker shaft 33, respectively. A radially extending clutch link arm 17 is fixed to shaft 2 in the region between bearings 15 and 20 for rocking movement of arm 17 in response to oscillating movement of feed rocker shaft 33. The bearings 15, 20 and 37 are located in spaced arms 15*a*, 20*a* and 37*a* extending laterally from and fixed to mounting strip 26. Feed rocker shaft 33 is clampingly attached, externally of sewing machine 8, to puller arm 11 through bore 13, which is formed by puller arm 11 and shaft pinch cap 23. The driving movement of feed rocker shaft 33 is transferred to roller 3 by arms 11, 4 and 17, respectively, wherein arm 11 is adjustably attached to arm 4 by engagement of pin 10 through slot 21 and arm 4 is lockingly attached to arm 17 by pin 6. Therefore, when feed rocker shaft 33 oscillates, arms 11, 4 and 17 oscillate in response, rotating roller 3, correspondingly, in feeding direction 28 only, due to the action of a first one-way clutch 17*a*. One-way clutch 17*a* is housed within clutch link arm 17 and prevents back-feeding, that is, prevents puller roller 3 from rotating in a direction opposite to feeding direction 28 as is well known in the art. In addition, a second one-way clutch 18 may be housed within bearing flange 37*a* which also further prevents back-feeding caused by puller roller 3 rotating in a direction opposite to feeding direction 28.

Both feed dog 25 and puller roller 3 are driven by feed rocker shaft 33, which engages feed stroke 29 of sewing machine 8. Therefore, feed dog 25 and puller roller 3 move in synchronization with the needle assembly to intermittently advance garment 5. Attaching feed rocker shaft 33 to puller roller 3 externally of sewing machine 8 has significant advantages over conventional, internally driven puller devices, which require the entire sewing machine 8 to be shut down for repair of the drive mechanism and puller roller. In contrast, the preferred puller roller 3 is attached externally of sewing machine 8, thereby eliminating down-time of sewing machine 8 during routine maintenance and repair of puller apparatus 1. In addition, driving puller roller 3 and feed dog 25 in synchronization with one another allows puller roller 3 to be "over-driven"(i.e. driven faster than feed dog 25) to assist feed dog 25 in uniformly feeding garment 5. Over-driving the puller roller 3 provides more uniform stitching as the puller apparatus 1 keeps the thread taut, particularly between garments for consistent and accurate separation. Furthermore, the puller apparatus 1 eliminates the need for the operator to physically guide the garment to ensure proper orientation and feeding.

The preferred engagers and controllers of puller apparatus 1 comprise first and second compensating presser feet 22, 24 for engaging top surface 30 of garment 5 and first and second pneumatic cylinders 12, 14, respectively, for controlling the presser feet 22, 24. Presser feet 22, 24 comprise treated surfaces adjacent to puller roller 3 in the preferred embodiment to expedite the movement of garment 5. Presser feet 22, 24 and pneumatic cylinders 12, 14 are mounted on bracket 9, which is lockingly attached to sewing machine 8. Mounting bracket 9 may be attached to sewing machine 8 in a variety of ways without deviating from the intent of the invention. In the preferred embodiment, the air supply provided to pneumatic cylinders 12, 14 is fed through individual air lines 42, 44 (FIG. 3), for individual control of presser feet 22, 24; however, the air supply could be combined into one air line 46 without deviating from the intent of the invention.

Figure 3:
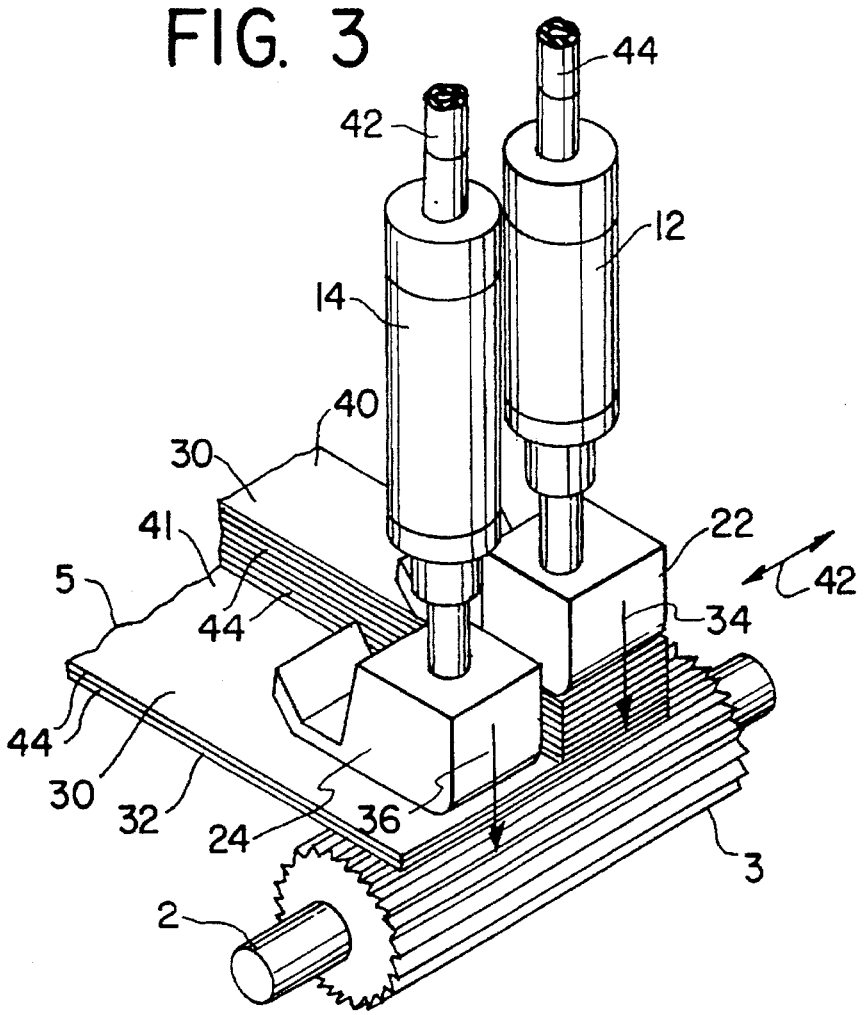
FIG. 3 is a perspective view of the compensating presser feet's motion in relation to the puller roller during engagement with the garment in the preferred embodiment of the present invention, wherein the variable thickness garment comprises first and second adjacent portions, at least one of which has multiple layers.

Referring to FIG. 3, pneumatic cylinders 12, 14 control the engagement of presser feet 22, 24 with garment 5 in a vertical direction 34, 36. Pneumatic cylinders 12, 14 may be activated individually or collectively to control the engagement of one or both presser feet, 22, 24, thereby accommodating first and second adjacent portions 40, 41, at least one of which has multiple layers. Pneumatic cylinders 12, 14 are preferably spring loaded and thus, self-adjusting to the variance in thickness of the plys of material in garment 5. Furthermore, in the event of a misfeed or faulty stitching, the air supply can be turned off and the cylinders 12, 14 will move upward, away from garment 5. This enables the operator to remove garment 5 from the puller apparatus 1 to repair or correct without disrupting the cycle.

For illustration purposes only, portion 40 of FIG. 3 comprises six layers 44 and portion 41 comprises two layers 44 to simulate the fabric thickness in the commercial fabrication of jean slacks, which requires a larger layer thickness to be sewn under one presser foot 22 and a smaller layer thickness to be sewn under another presser foot 24. Presser feet 22, 24 may also be adjusted in a lateral direction 42 to further accommodate varying widths of first and second adjacent portions 40, 41 of garment 5 by threading the shafts of pneumatic cylinders 12, 14 to provide the adjustment capability.

In the preferred embodiment, presser feet 22, 24 engage garment 5 substantially above puller roller 3. Thus, upon activation of pneumatic cylinders 12, 14, presser feet 22, 24 engage top surface 30 of garment 5 while feed dog 25 and puller roller engage bottom surface 32. When pneumatic cylinders 12, 14 are activated, presser feet 22, 24, urge bottom surface 32 of garment 5 against the serrated surface of rotating puller roller 3, thereby uniformly pulling garment 5 in a controlled path for improved stitching. Puller roller 3 moves intermittently as the needle assembly disengages top surface 30, thereby preventing needle breakage after stitching garment 5 with conventional thread. In addition, puller roller 3 pulls garment 5 uniformly, downstream of the stitch-forming mechanism, whereby excess thread may be cut from garment 5. An advantage resulting from this invention is that downtime of sewing machine 8 is reduced since the variable thickness portions 40, 41 of garment 5 are less likely to "bunch", as with conventional puller devices, as garment 5 is fed between presser feet 22, 24 and puller roller 3. Therefore, providing multiple presser feet 22, 24 in conjunction with puller roller 3 provides a solution to the problem of stitching adjacent portions 40, 41 of a variable thickness garment 5.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. An apparatus in combination with a sewing machine having a stitchformer that utilizes thread, alternately engageable and disengageable with a garment having portions of different thickness material, and a feeder for feeding the garment through the stitch-former when the stitch-former is disengaged from the garment, comprising:

a puller downstream of the feeder for uniformly pulling the garment when the stitch-former is disengaged from the garment;

a driver for driving said puller in synchronization with the stitch-former, said driver intermittently driving said puller for advancing the garment when the stitch-former is disengaged from the garment;

first and second engagers positioned adjacent said puller; and first and second controllers operatively connected to said first and second engagers, respectively, for selectively moving said first and second engagers into and out of engagement with the portions of different thickness material of the garment, for urging the garment against said puller when the stitch-former is disengaged from the garment.

2. The apparatus of claim 1, wherein said puller pulls the garment downstream of the stitch-former so that excess thread may be cut from the garment.

3. The apparatus of claim 1, wherein the garment has a top surface and a bottom surface, said first and second engagers engaging said top surface of the garment and the feeder and said puller engaging said bottom surface of the garment.

4. The apparatus of claim 1, wherein the garment having portions of different thickness material has first and second adjacent portions, at least one of which has multiple layers of fabric.

5. The apparatus of claim 1, wherein the feeder comprises a feed dog.

6. The apparatus of claim 1, wherein said puller comprises a roller having a serrated peripheral surface.

7. The apparatus of claim 1, wherein said puller is attached externally of the sewing machine.

8. The apparatus of claim 1, wherein said driver is clampingly attached to the feeder.

9. The apparatus of claim 1, wherein said driver comprises a feed rocker shaft.

10. The apparatus of claim 1, wherein said first and second engagers comprise first and second presser feet, respectively.

11. The apparatus of claim 1, wherein said first and second controllers function independently of one another, thereby selectively moving said first and second engagers, respectively, to accommodate the portions of different thickness material, at least one of which has multiple layers.

12. The apparatus of claim 1, wherein said first and second controllers comprise first and second pneumatic cylinders, respectively.

13. The apparatus of claim 1, wherein said first and second engagers are spring loaded.

14. The apparatus of claim 1, wherein said first and second controllers are laterally adjustable to further accommodate the portions of different thickness material, at least one of which has multiple layers of fabric.

15. The apparatus of claim 1, further comprising a first one-way clutch which allows said driver to drive said puller in a feeding direction only.

16. The apparatus of claim 15, wherein said first one-way clutch is connected between said driver and said puller.

17. The apparatus of claim 15, further comprising a second one-way clutch which is connected to said puller, opposite said driver, and further allows said puller to rotate in said feeding direction only.

18. An apparatus in combination with a sewing machine having a stitch-former, alternately engageable and disengageable with a variable thickness garment having first and second adjacent portions, at least one of which has multiple layers of fabric, and top and bottom surfaces of said first and second portions, wherein the stitch-former engages the top surface of the garment for stitching the garment and a feeder engages a bottom surface of the garment for feeding the garment through the stitch-former when the stitch-former is disengaged from the garment, comprising:

a puller downstream of the feeder for uniformly pulling the garment in synchronization with the feeder when the stitch-former is disengaged from the garment;

a driver for driving the feeder and said puller in synchronization with the stitch-former, intermittently engaging said puller for advancing the garment when the stitch-former is disengaged from the top surface of the garment and intermittently disengaging said puller when the stitch-former is engaged with the top surface of the garment;

first and second engagers positioned substantially above said puller for engaging the top surface of the garment as the feeder and said puller engage the bottom surface of the garment; and first and second controllers operatively connected to said first and second engagers for selectively and independently moving said first and second engagers into and out of engagement with the top surface of the garment.

19. The apparatus of claim 18, wherein said puller pulls the garment downstream of the stitch-former so that excess thread may be cut from the garment.

20. The apparatus of claim 18, wherein the feeder comprises a feed dog.

21. The apparatus of claim 18, wherein said puller comprising a roller having a serrated peripheral surface.

22. The apparatus of claim 18, wherein said puller is attached externally of the sewing machine.

23. The apparatus of claim 18, wherein said driver is clampingly attached to the feeder.

24. The apparatus of claim 18, wherein said driver comprises a feed rocker shaft.

25. The apparatus of claim 18, wherein said first and second engagers comprise first and second presser feet, respectively.

26. The apparatus of claim 18, wherein said first and second controllers comprise first and second pneumatic cylinders, respectively.

27. The apparatus of claim 18, wherein said first and second engagers are spring loaded.

28. The apparatus of claim 18, wherein said First and second controllers are laterally adjustable to further accommodate the first and second adjacent portions, at least one of which has multiple layers of fabric.

29. The apparatus of claim 18, further comprising a first one-way clutch which allows said driver to drive said puller in a feeding direction only.

30. The apparatus of claim 29, wherein said first one-way clutch is connected between said driver and said puller.

31. The apparatus of claim 29, further comprising a second one-way clutch which is connected to said puller, opposite said driver, and further allows said puller to rotate in said feeding direction only.

* * * * *